US010221851B2

(12) United States Patent
Ishii et al.

(10) Patent No.: US 10,221,851 B2
(45) Date of Patent: Mar. 5, 2019

(54) TRANSVERSE INTERNAL GEAR PUMP

(71) Applicant: NTN CORPORATION, Osaka (JP)

(72) Inventors: Takuya Ishii, Mie (JP); Kei Hattori, Mie (JP)

(73) Assignee: NTN CORPORATION, Osaka (JP)

( * ) Notice: Subject to any disclaimer, the term of this patent is extended or adjusted under 35 U.S.C. 154(b) by 66 days.

(21) Appl. No.: 15/117,274

(22) PCT Filed: Jan. 30, 2015

(86) PCT No.: PCT/JP2015/052635
§ 371 (c)(1),
(2) Date: Aug. 8, 2016

(87) PCT Pub. No.: WO2015/119050
PCT Pub. Date: Aug. 13, 2015

(65) Prior Publication Data

US 2016/0348675 A1 Dec. 1, 2016

(30) Foreign Application Priority Data

Feb. 6, 2014 (JP) ..... 2014-020976

(51) Int. Cl.
*F01C 1/10* (2006.01)
*F03C 2/00* (2006.01)
(Continued)

(52) U.S. Cl.
CPC ..... *F04C 15/06* (2013.01); *F04C 2/102* (2013.01); *F04C 11/001* (2013.01);
(Continued)

(58) Field of Classification Search
CPC ..... F04C 2/102; F04C 11/001; F04C 15/06; F04C 15/0003; F04C 18/0215;
(Continued)

(56) References Cited

U.S. PATENT DOCUMENTS 2,968,251 A * 1/1961 Eames, Jr. ..... F04C 2/102 418/171
6,227,828 B1 * 5/2001 Takeuchi ..... F04C 2/086 418/47

(Continued)

FOREIGN PATENT DOCUMENTS

CN 101137845 A 3/2008
EP 0811767 A1 12/1997

(Continued)

OTHER PUBLICATIONS

Supplementary European Search Report dated Jun. 23, 2017.

(Continued)

*Primary Examiner* — Theresa Trieu
(74) *Attorney, Agent, or Firm* — Hedman & Costigan, P.C.; James V. Costigan; Kathleen A. Costigan

(57) ABSTRACT

A transverse internal gear pump 1 having a trochoid 4, in which an inner rotor 3 having a plurality of outer teeth is rotatably accommodated within an outer rotor 2 having a plurality of inner teeth, the inner rotor being rotatably accommodated within the outer rotor in an eccentric state and with the outer teeth and the inner teeth meshing, and in which an intake-side volume chamber for taking in a liquid and an ejection-side volume chamber for ejecting liquid taken into the intake-side volume chamber are formed between the inner teeth and the outer teeth; a liquid intake nozzle 9 extending in a non-perpendicular direction with respect to the trochoid rotation surfaces and having a distal end immersed in a liquid reservoir 18; a pump casing 5 in which a recessed portion 5*a* for accommodating the trochoid is formed; and a pump cover 6.

3 Claims, 8 Drawing Sheets

(51) Int. Cl.

| | |
|---|---|
| ***F03C 4/00*** | (2006.01) |
| ***F04C 2/00*** | (2006.01) |
| ***F04C 15/06*** | (2006.01) |
| ***F04C 2/10*** | (2006.01) |
| ***F04C 11/00*** | (2006.01) |
| ***F04C 15/00*** | (2006.01) |
| ***F04C 18/02*** | (2006.01) |

(52) U.S. Cl.
CPC ..... *F04C 15/0003* (2013.01); *F04C 18/0215* (2013.01); *F04C 2230/20* (2013.01); *F04C 2230/21* (2013.01); *F04C 2230/60* (2013.01); *F04C 2240/30* (2013.01); *F05C 2225/00* (2013.01)

(58) Field of Classification Search
CPC ..... F04C 2230/20; F04C 2230/21; F04C 2230/60; F04C 2240/30; F05C 2225/00
USPC .... 418/88, 94, 55.1–55.6, 57, 152, 166, 171
See application file for complete search history.

(56) References Cited

U.S. PATENT DOCUMENTS

| | | | | |
|---|---|---|---|---|
| 6,422,346 | B1 | 7/2002 | Gilbert | |
| 2007/0231177 | A1* | 10/2007 | Yamaguchi | F04C 2/102 418/166 |
| 2008/0085963 | A1* | 4/2008 | Akiyama | C08K 3/24 524/406 |
| 2008/0159884 | A1* | 7/2008 | Nakanishi | F04C 2/08415 417/410.4 |
| 2011/0129378 | A1 | 6/2011 | Hasegawa et al. | |
| 2011/0269879 | A1* | 11/2011 | Kim | C08K 5/3477 524/101 |

FOREIGN PATENT DOCUMENTS

| | | | |
|---|---|---|---|
| EP | 2309132 | A1 | 4/2011 |
| JP | 62-18391 | U | 2/1987 |
| JP | 02-086972 | A | 3/1990 |
| JP | 07-189960 | A | 7/1995 |
| JP | 07-208348 | A | 8/1995 |
| JP | 3864452 | B2 | 12/2006 |
| JP | 2007-009787 | A | 1/2007 |
| JP | 2008-121600 | A | 5/2008 |
| JP | 5285988 | B2 | 9/2013 |
| WO | 2010/010790 | A1 | 1/2010 |

OTHER PUBLICATIONS

English Abstract for JP 07-208348 A dated Aug. 8, 1995.
International Search Report for PCT/JP2015/052635 dated Apr. 28, 2015.
English Abstract for CN 101137845 A dated Mar. 5, 2008.
English Claims for JP 62-18391 U dated Feb. 3, 1987.
English Abstract for JP 02-086972 A dated Mar. 27, 1990.
English Abstract for JP 2008-121600 A dated May 29, 2008.
English Abstract for JP 2007-009787 A dated Jan. 18, 2007.

* cited by examiner

TRANSVERSE INTERNAL GEAR PUMP

TECHNICAL FIELD

The present invention relates to an internal gear pump (trochoid pump) for pumping liquids such as oil, water, or chemical solutions, and relates in particular to a transverse internal gear pump designed to be used while installed in a transverse orientation.

BACKGROUND ART

An internal gear pump (trochoid pump) is a pump that has an outer rotor and an inner rotor, which have trochoid teeth profiles and which are accommodated in a sealed state within a casing; the inner rotor, which is secured to a drive shaft, and the outer rotor rotating in association with rotation of the drive shaft, and acting so as to take in and eject a liquid. Specifically, the internal gear pump has the following structure. The trochoid is constituted by outer teeth of the inner rotor meshing with inner teeth of the outer rotor, and the inner rotor being rotatably accommodated within the outer rotor in a state of eccentricity. At intervals between dividing points when the rotors come into contact with one another, volume chambers are formed at the intake side and the ejection side, according to the direction of rotation of the trochoid. When the drive shaft rotates and the inner rotor rotates, the outer teeth mesh with the inner teeth of the outer rotor, thereby causing the outer rotor to turn in unison in the same direction. Liquid is taken in from the intake port into the intake-side volume chamber, which, due to this rotation, has expanded in volume and reached negative pressure. As this intake-side volume chamber, due to rotation of the trochoid, decreases in volume and changes to an ejection-side volume chamber, the liquid taken in is ejected therefrom to an ejection port. A liquid intake nozzle is provided as a communicating passage through which the liquid is supplied to the intake-side volume chamber, and the tip of the nozzle is immersed in a liquid reservoir.

One known internal gear pump of this type is that disclosed, for example, in Patent Document 1. Patent Document 1 discloses a transverse internal gear pump installed in a transverse orientation (Patent Document 1, FIGS. 1, 3), and a vertical internal gear pump installed in a vertical orientation (Patent Document 1, FIG. 4), as configurations in which a pump is installed. In the case of a transverse type, the drive shaft of the pump is in a transverse orientation, and the trochoid rotation surfaces are surfaces that are approximately parallel to the vertical direction, whereas in the case of the vertical orientation, the drive shaft of the pump is oriented on the vertical, and the trochoid rotation surfaces are surfaces that are approximately perpendicular to the vertical direction. Here, because it is necessary for the tip of the liquid intake nozzle to be immersed below the liquid surface of the liquid, such as lubricating oil, held in the liquid reservoir, it is necessary to extend the nozzle downward in the vertical direction. For this reason, in the vertical orientation, the liquid intake nozzle is arranged approximately perpendicular to the trochoid rotation surfaces (approximately parallel to the drive shaft), and in the transverse orientation, is arranged non-perpendicular to the trochoid rotation surfaces (non-parallel to the drive shaft).

In Patent Document 1, as transverse internal gear pumps in particular, there are proposed units having a intake nozzle and a pump cover linked thereto, at least one of the intake nozzle and a pump cover comprising a thermoplastic plastic material, where (1) the intake nozzle and the pump cover are secured by plastic working, or (2) the intake nozzle and the pump cover are integrally molded by pressing.

PRIOR ARTS LIST

Patent Documents

Patent Document 1: Japanese Patent No. 3864452

SUMMARY OF THE INVENTION

Problems to be Solved by the Invention

However, in either of modes (1) and (2) of Patent Document 1, there is a risk that the reliability of the seal of the joined section of the intake nozzle and the cover may be insufficient in the event of prolonged use of several to ten or more years. Specifically, in the case (1), when a joined section produced by plastic working is subjected to thermal shock due to a temperature differential between the outside air (−40° C. to −30° C.) and that during use (120° C. to 150° C.), cracking or other adverse events may occur. In particular, when either the intake nozzle or the cover is formed from a thermoplastic plastic material, diminished sealing due to cracking or the like may be promoted by a thermal expansion differential between the members. In the case of (2), because pressed parts (metal parts) are used, it is difficult to achieve a complete seal, and variability occurs. Additionally, steps for pressing or plastic working of members formed as separate parts are required, leading to increased manufacturing costs. Moreover, in cases where the pump is used to supply a liquid to a sliding section of a scroll compressor, when the ejection pressure is high, and particularly in instances where the refrigerant is carbon dioxide gas, the pressure can be 8 MPa or more, and in some instances 10 MPa or more, and therefore high sealing properties and reliability are required of the flow passage.

The present invention was contrived in order to solve the aforementioned problems, it being an object thereof to provide a transverse internal gear pump that can be manufactured at low cost, and that has a high safety factor in term of functionality as well.

Means for Solving the Problem

The transverse internal gear pump of the present invention has a trochoid in which an inner rotor having a plurality of outer teeth is rotatably accommodated within an outer rotor having a plurality of inner teeth, the inner rotor being rotatably accommodated within the outer rotor in an eccentric state and with the outer teeth and the inner teeth meshing, and in which an intake-side volume chamber for taking in a liquid and an ejection-side volume chamber for ejecting liquid taken into the intake-side volume chamber are formed between the inner teeth and the outer teeth; and a liquid intake nozzle extending in a non-perpendicular direction with respect to the trochoid rotation surfaces, the liquid intake nozzle having a distal end immersed in a liquid reservoir of the liquid, and forming part of a passage via which the liquid communicates with the intake-side volume chamber, wherein the transverse internal gear pump is characterized by having a pump casing in which a recessed portion for accommodating the trochoid is formed, and a pump cover for closing off the recessed portion, an intake cover having the liquid intake nozzle being secured to either the pump casing or the pump cover, and the liquid intake nozzle and the intake cover being integrally molded by the injection molding of a resin composition.

A further characterizing feature is that the intake cover and the member to which the intake cover is secured, are arranged with portions thereof fitted together with a seal member interposed therebetween, and are secured using a retaining ring fitted therein so as to span the member and the intake cover.

A further characterizing feature is that the intake cover and the member to which the intake cover is secured, are arranged with portions thereof fitted together with a seal member interposed therebetween, and are secured using elastically deforming engaging portions provided to the member and the intake cover.

A further characterizing feature is that a port linking the liquid intake nozzle interior and a space in the interior of the intake cover is disposed in a location that, when the pump is installed, is above a vertically central portion of the space in the interior of the intake cover.

A further characterizing feature is that the resin composition is a resin composition in which a polyphenylene sulfide resin is used as a base resin, and at least one material selected from glass fibers, carbon fibers, and inorganic fillers is incorporated therein.

The transverse internal gear pump is characterized in being a pump for supplying the liquid to a sliding section of a scroll compressor.

Effect of the Invention

The transverse internal gear pump of the present invention is a transverse pump of a structure having a pump casing in which is formed a recessed portion for accommodating a trochoid which is constituted by an outer rotor and an inner rotor; a pump cover for closing off the recessed portion; and a liquid intake nozzle via which a liquid to be pumped is taken in from a liquid reservoir, wherein an intake cover having the liquid intake nozzle is secured to either the pump casing or the pump cover, and the liquid intake nozzle and the intake cover are integrally molded by the injection molding of a resin composition, whereby the liquid intake nozzle and the intake cover are manufactured as separate elements, and the risk of diminished sealing in the sections is negligible as compared with members unified through plastic working or pressing, providing high reliability (safety). Moreover, steps such as plastic working, pressing, and the like can be reduced, and production cost reductions can be achieved.

Because the intake cover and the member to which the intake cover is secured are arranged with portions thereof fitted together with a seal member interposed therebetween, and secured using a retaining ring fitted so as to span the member and the intake cover, high sealing performance can be maintained for extended periods, and reliability further improved.

Because the intake cover and the member to which the intake cover is secured are arranged with portions thereof fitted together with a seal member interposed therebetween, and secured using elastically-deforming engaging portions provided to the member and the intake cover, high sealing performance can be maintained, and ease of the assembly operation is excellent Because the resin composition for forming the liquid intake nozzle and the intake cover is a resin composition comprising a base resin of a polyphenylene sulfide resin, and at least one material selected from glass fibers, carbon fibers, and inorganic fillers incorporated therein, oil resistance and chemical resistance are excellent, and use is possible in high-temperature environments exceeding 120° C., such as in compressors, and dimensional accuracy is greatly improved as well.

Due to having specifications like those set forth above, the transverse internal gear pump of the present invention can be used suitably as a pump for supplying a liquid to a sliding section of a scroll compressor for use in an air conditioner.

MODE FOR CARRYING OUT THE INVENTION

Figure 1:
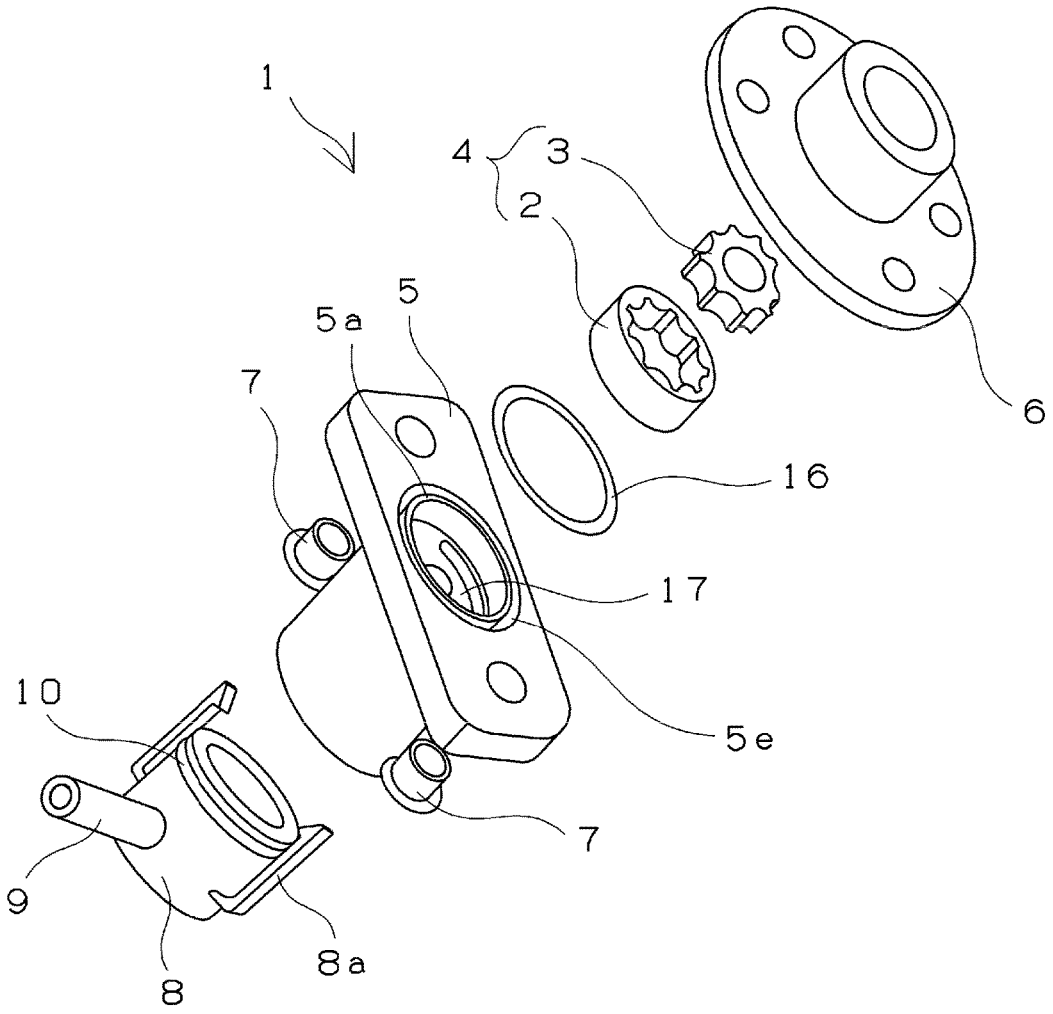
FIG. 1 is an assembled perspective view showing an example of the transverse internal gear pump of the present invention.
Figure 2:
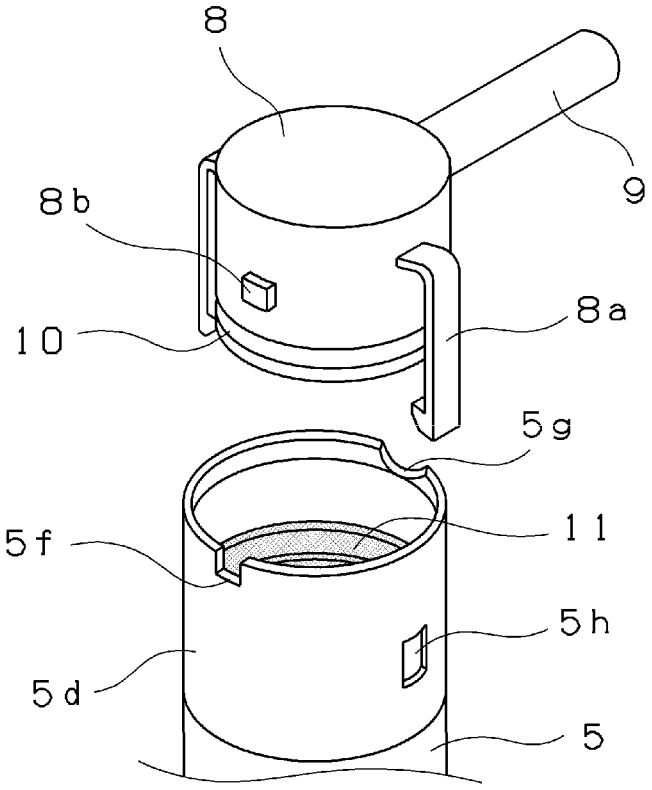
FIG. 2 is a partial perspective view seen from the intake cover side in FIG. 1.
Figure 3:
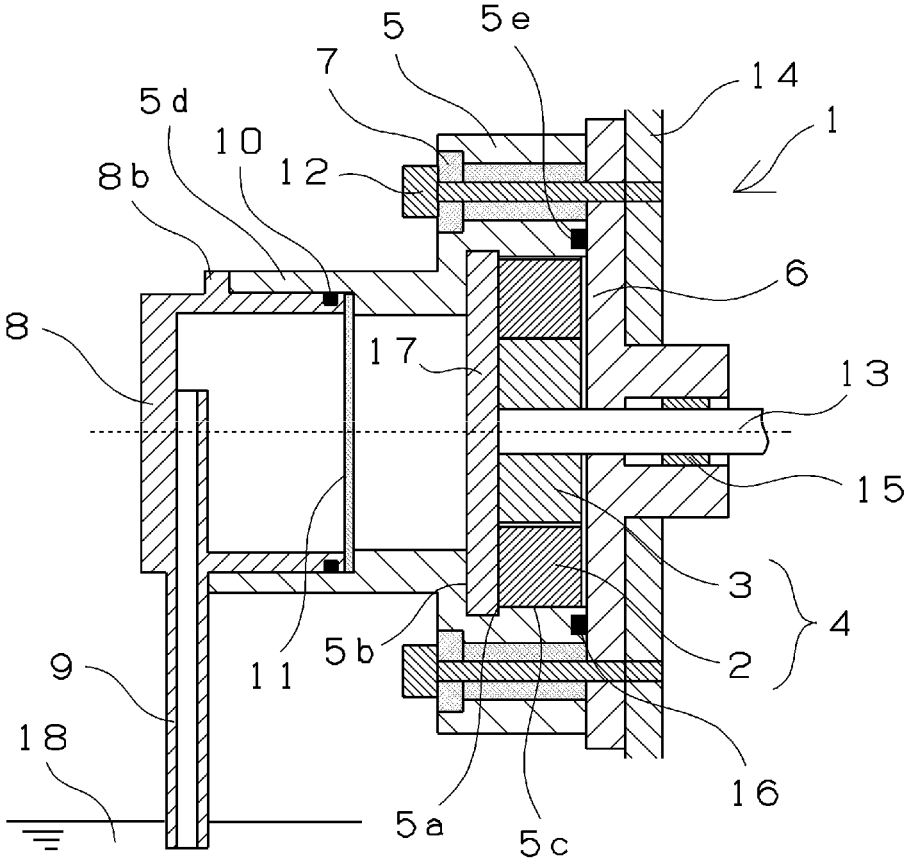
FIG. 3 is an axial cross-sectional view of the transverse internal gear pump of FIG. 1.

An embodiment of the transverse internal gear pump of the present invention shall be described on the basis of FIGS. 1 to 3. FIG. 1 shows an assembled perspective view of a transverse internal gear pump that utilizes a snap-fit, FIG. 2 a partial assembled perspective view seen from the intake cover side, and FIG. 3 an axial cross-sectional view of the transverse internal gear pump of FIG. 1, respectively. As shown in FIGS. 1 and 3, the transverse internal gear pump of the present embodiment has a trochoid 4 in which an inner rotor 3 is accommodated inside an annular outer rotor 2; a pump casing 5 in which is formed a circular recessed portion 5*a* (trochoid-accommodating recessed portion) for rotatably accommodating the trochoid 4; and a pump cover 6 for closing off the trochoid-accommodating recessed portion 5*a* of the pump casing 5. The pump cover 6 is a shape that conforms to the upper surface of the pump casing 5 into which the trochoid-accommodating recessed portion 5*a* opens. As shown in FIG. 3, the pump casing 5 and the pump cover 6 are securely fastened to a securing plate 14 of a machine body by securing screws 12. A drive shaft 13 secured coaxially at the center of rotation of the inner rotor 3 is provided. The drive shaft 13 is supported by a bearing (sintered bushing) 15, which is press-fitted into the pump cover 6. For the bearing 15, it would also be acceptable to form a slide bearing part injection-molded directly on the cover 6 using a plastic material.

The number of outer teeth of the inner rotor 3 is lower by one than the number of inner teeth of the outer rotor 2, the inner rotor 3 being accommodated within the outer rotor 2 in a state of eccentricity with the outer teeth internally contacting and meshing with inner teeth. At intervals between dividing points when the rotors come into contact with one another, volume chambers are formed at the intake side and the ejection side, according to the direction of rotation of the trochoid 4. In a bottom surface 5*b* of the trochoid-accommodating recessed portion 5*a* of the pump casing 5 are formed an intake port which communicates with the intake-side volume chamber, and an ejection port which communicates with the ejection-side volume chamber. The intake port leads to an internal space of a cylindrical part 5*d* of the pump casing 5. A liquid, such as lubricating oil, held in a liquid reservoir 18 is supplied to the intake port through a communicating passage for the liquid formed by the internal space of the cylindrical part 5*d* of the pump casing 5, the internal space of the intake cover 8, and the liquid intake nozzle 9.

As shown in FIG. 2, the intake cover 8 is provided with a cylindrical body of smaller diameter than the cylindrical part 5*d* of the pump casing 5, and the liquid intake nozzle 9, which is integrally molded therewith. The intake cover 8 has engagement protuberances 8*a*, while the pump casing 5 has engagement holes 5*h* adapted to engage the engagement protuberances 8*a*. Elastically deforming engaging portions are constituted by the engagement protuberances 8*a* and the engagement holes 5*h*. The intake cover 8 is mated with the cylindrical part 5*d* of the pump casing 5 with a seal member 10 interposed therebetween, and is secured in a snap-fit fashion by the engagement protuberances 8*a* engaging in the engagement holes 5*h*. The intake cover 8 has a protruding portion 8*b*, while the pump casing 5 has a recessed portion 5*f*, the protruding portion 8*b* and the recessed portion 5*f* being adapted to mate and thereby prevent the intake cover 8 and the pump casing 5 from rotating in a circumferential direction. A recessed portion 5*g* of the pump casing 5 receives the liquid intake nozzle 9. These recessed and protruding portions also serve as positioning portions during snap-fit assembly. Provided that the engaging portions are structures by which the intake cover and the pump casing can be secured by elastic deformation, there is no particular limitation to the shapes of the illustrated engagement protuberances and engagement holes.

There are no particular limitations as to the material of the seal member 10, and rubber materials that conform to the application and service environment, such as hydrogenated nitrile rubber, fluororubber, or acrylic rubber may be selected. For example, scroll compressors used in an air conditioner require heat resistance from about −30 to 120° C., and oil resistance, for which reason hydrogenated nitrile rubber (H-NBR) is preferably employed.

In the transverse internal gear pump 1 shown in FIGS. 1 and 3, liquid is taken from the intake chamber into the intake-side volume chamber which, through rotation of the trochoid 4 by the drive shaft 13, expands in volume and reaches negative pressure. As this intake-side volume chamber, due to rotation of the trochoid 4, decreases in volume and changes to an ejection-side volume chamber, the liquid taken in is ejected therefrom to an ejection port. Through rotation of the trochoid 4, the aforedescribed pump action is carried out continuously, and the liquid is continuously pumped. Further, due to a liquid sealing effect whereby the sealing properties of the volume chambers are enhanced by the taken-in liquid, the pressure differential between the volume chambers becomes considerable, and strong pumping action is obtained.

As shown in FIG. 3, in the transverse internal gear pump 1, during service the drive shaft 13 is in a transverse (horizontal) orientation, and the rotation surfaces of the trochoid 4 are surfaces approximately parallel to the vertical direction. The liquid intake nozzle 9 extends downward in the approximately vertical direction (a non-perpendicular direction with respect the rotation surfaces of the trochoid 4), and the distal end is immersed in the liquid reservoir 18. In the present invention, "transverse" refers not only to a case of completely horizontal installation angle, but includes angles ranging from about 0° (the horizontal) to 45° with respect to a horizontal plane as well. The direction of extension of the liquid intake nozzle 9 with respect the rotation surfaces of the trochoid 4 may be determined appropriately, depending on the installation incline angle, so that the distal end is immersed in the liquid reservoir 18.

The linking port linking the liquid intake nozzle 9 and the interior space of the intake cover 8 is disposed in a location above a vertical center portion of the interior space of the intake cover 8 at the time of pump installation. In so doing, even when the pump is stopped, an ample amount of liquid is held in the interior spaces of the intake cover 8 and the cylindrical part 5*d* of the pump casing 5, and operation in a state when no liquid is present in the trochoid during restart of the system can be avoided.

A metal filter 11 is secured to the cylindrical part 5d of the pump casing 5. The metal filter 11 is provided as needed, in order to prevent incorporation of foreign matter into the trochoid 4. In cases in which the pump casing 5 is made of a plastic, the metal filter 11 can be secured by welding, using ultrasonic welding or laser welding.

In the state shown in FIGS. 1 to 3, the pump casing 5, the intake cover 8, and the liquid intake nozzle 9 are injection-molded from a resin composition. A principal feature of the present invention in particular is that the liquid intake nozzle 9 and the intake cover 8 are an integrally molded part that has been integrally molded by the injection molding of a resin composition. By adopting an integrally molded part as the liquid intake nozzle and the intake cover, the risk of diminished sealing in sections is eliminated, as contrasted with parts manufactured as separate components and integrated through plastic working or pressing, and reliability is higher. Moreover, fewer steps such as plastic working, pressing, and the like are involved, and manufacturing costs can be reduced.

An injection-moldable synthetic resin is employed as the base resin in the resin composition for forming the liquid intake nozzle, the intake cover, and the pump casing. The resin composition employed to form the liquid intake nozzle and the intake cover, and the resin composition employed to form the pump casing, may differ, but in order to prevent diminished sealing in the mated portions of the intake cover and the pump casing, it is preferable to employ resin compositions having similar coefficients of linear expansion. Ideally, identical resin compositions will be used.

As the base resin, there may be cited, for example, thermoplastic polyimide resins, polyether ketone resins, polyether ether ketone (PEEK) resins, polyphenylene sulfide (PPS) resins, polyamide-imide resins, polyamide (PA) resins, polybutylene terephthalate (PBT) resins, polyethylene terephthalate (PET) resins, polyethylene (PE) resins, polyacetal resins, phenol resins, and the like. These resins may be used independently, or two or more varieties may be mixed to form a polymer alloy.

For use in the liquid intake nozzle and the pump casing, a base resin is preferably employed that can withstand pumped liquids such as oil, water, or chemical solutions, and that experiences minimal change in dimension induced by suctioning water or oil. In a scroll compressor, it is preferable to employ a resin that is heat resistant to 150° C. or above. As such resins having excellent chemical resistance, heat resistance, and dimensional stability, there may be cited PEEK resins, PPS resins, and the like. Of these heat-resistant resins, it is especially preferred to employ a PPS resin, due to the exceptional creep resistance, load resistance, wear resistance, etc., in articles molded therefrom, and low cost.

PPS resins are crystalline thermoplastic resins having a polymer structure linked by sulfur bonds at the para position of the benzene ring. The PPS resins have very high rigidity, as well as excellent heat resistance, dimensional stability, wear resistance, sliding properties, and the like. The PPS resins may be distinguished by molecular structure as cross-linked, semi-crosslinked, linear, and branched types or the like, of which it is preferable to employ a linear type. Using a linear PPS resin affords exceptional toughness, and when such a resin is used in a pump casing, cracks or the like in the flange portions thereof can be prevented. Where employed in an intake cover, cracking, bending, and the like of snap-fit parts can be prevented. As commercial PPS resins that can be used in the present invention, there may be cited #160 or B-063 made by Tosoh, T4AG or LR-2G made by DIC, and the like.

PEEK resins are crystalline thermoplastic resins having a polymer structure linked by carbonyl groups and ether linkages at the para position of the benzene ring. In addition to excellent heat resistance, creep resistance, load resistance, wear resistance, sliding properties, and the like, PEEK resins have excellent moldability. As commercial PEEK resins that can be used in the present invention, there may be cited PEEK (90P, 150P, 380P, 450P and the like) made by Victrex, KETASPIRE (KT-820P, KT-880P, and the like) made by Solvay Advanced Polymers, VESTAKEEP (1000G, 2000G, 3000G, 4000G, and the like) made by Daicel-Degussa, and the like.

Commercially marketed PE resins include PE of a wide range of molecular weights, from low molecular weight to ultra-high molecular weight. However, ultra-high molecular weight PE having weight-average molecular weight in excess of 1,000,000 cannot be injection-molded, and therefore cannot be used in the present invention. PE of higher molecular weight has higher material properties and wear resistance, and therefore it is preferable to employ one of high-molecular weight that can be injection-molded. As commercial PE resins that can be used in the present invention, there may be cited, for example, LUBMER L5000, L4000, and the like, made by Mitsui Chemical.

As PA resins that can be used in the present invention, there may be cited polyamide 6 (PA6) resin, polyamide 6-6 (PA66) resin, polyamide 6-10 (PA610) resin, polyamide 6-12 (PA612) resin, polyamide 4-6 (PA46) resin, polyamide 9-T (PA9T) resin, modified PA9T resin, polyamide 6-T (PA6T) resin, modified PA6T resin, polymeta-xylene adipamide (polyamide MXD-6) resin, and the like. The numbers in the polyamide resins represent the number of carbons between amide bonds, and T denotes a terephthalic acid residue.

There are three types of polyacetal resins that can be used in the present invention: homopolymers, copolymers, and block copolymers. As a thermoplastic polyimide resin that can be used in the present invention, there may be cited, for example, AURUM made by Mitsui Chemical. Phenolic resins are injection-moldable thermosetting resins, and include novolac and resol types, which can be used with no particular limitations.

It is preferable to incorporate additives into the resin composition. For example, there can be incorporated reinforcers to increase the strength, elasticity, and dimensional stability, such as glass fibers, carbon fibers, whiskers, mica, talc, and the like; inorganic fillers (powder, granular) for imparting wear resistance or eliminating anisotropy in injection molding shrinkage, such as minerals, calcium carbonate, glass beads, and the like; or solid lubricants for imparting lubricity, such as graphite, PTFE resin, or the like. Among these, it is preferable for glass fibers, carbon fibers, or inorganic fillers, which are effective for increasing the strength, elasticity, dimensional stability, or wear resistance or eliminating anisotropy of injection molding shrinkage, to be used independently or concomitantly, as appropriate. In particular, the joint use of glass fibers and inorganic fillers is highly cost-effective, and produces excellent wear resistance characteristics in oil. In applications other than oil, such as water, chemical solutions, and the like, the joint use of carbon fibers and inorganic fillers produces better wear resistance than does the joint use of glass fibers and inorganic fillers. Qualities such as wear resistance are not particularly required of the resin composition forming the intake cover (with attached liquid intake nozzle), but as noted above, in order to prevent a decline in sealing properties in mate-secured parts of the intake cover and the pump casing, it is preferable to incorporate additives of the same type into the resin composition for forming the pump casing.

In the present invention, it is particularly preferable to employ a resin composition in which a linear PPS resin is used as a base resin, and glass fibers or glass beads are incorporated therewith. This configuration affords exceptional oil resistance and chemical resistance, while enabling use even in high-temperature environments exceeding 120° C. such as in compressors. Toughness is excellent, warp in flange portions is minimal due to elimination of anisotropy of injection molding shrinkage, and dimensional stability is greatly improved as well.

The proportions in which the additives are incorporated should fall within ranges such that the desired characteristics can be imparted without impairing the injection moldability. For example, fibrous reinforcing agents such as glass fibers, carbon fibers, and the like may be incorporated in an amount of 3-30 vol %, and inorganic fillers such as minerals, calcium carbonate, glass beads, and the like, may be incorporated in amounts of 1-20 vol %, respectively, with respect to the entire resin composition.

There are no particular limitations as to the means for mixing and kneading the various starting materials above. Pulverulent starting materials can be dry-mixed in a Henschel mixer, ball mixer, ribbon blender, Lodige mixer, ultra Henschel mixer, or the like, or melt-kneaded in a melt extruder such as a twin-screw melt extruder, to obtain molding pellets (granules). During melt-kneading in a twin-screw melt extruder or the like, a side feed may be adopted for charging the filler material. Using these molding pellets, the intake cover (with attached liquid intake nozzle) and the pump casing are molded by extruding. Processes such as annealing may also be adopted for molded articles.

In the embodiment shown in FIGS. 1 to 3, the outer rotor 2, the inner rotor 3, and the pump cover 6 are sintered metal bodies. The pump casing 5 is an extruded body of a resin composition as described above. Due to this configuration, during the process of securing the pump casing 5 and the pump cover 6 with screws to the main unit, the pump casing 5, which is a molded resin body, deforms so as to conform to the mating surface side thereof facing the pump cover 6, which is a sintered metal body. This allows leakage of liquid, or variability in the ejected amount, to be minimized. Further, the necessary dimensional accuracy can be ensured without mechanical working of the sinter-molded surfaces and extruded surfaces, and therefore the mating surfaces of the pump casing 5 and the pump cover 6, and the bottom surface 5*b* and side surface 5*c* of the trochoid-accommodating recessed portion 5*a*, can be non-machined extruded surfaces or sinter-molded surfaces, resulting in an inexpensive transverse internal gear pump.

The sintered metal used for the outer rotor, the inner rotor, and the pump cover can be any of iron-based, copper-iron based, copper-based, or stainless steel-based metals, but a hard iron-based metal is preferred, in order to reduce wear during sliding contact against the resin composition. Iron-based materials are also preferable from a cost standpoint. However, for a trochoid that will pump water, a chemical solution, or the like, stainless steel of high anticorrosion capability should be adopted.

A metal plate 17 that is a disc-shaped metal body is integrated through composite molding into the interior of the pump casing 5. More specifically, when the pump casing 5 is extruded, the metal plate 17 is arranged within the mold, and integrated through composite molding (insert molding). Liquid passages such as the aforementioned intake port and ejection port are formed in the metal plate 17, and the disk surface apart from the liquid passages is smooth. Using the metal plate 17, the bottom surface 5*b* of the trochoid-accommodating recessed portion 5*a* is formed, and the side surface 5*c* is formed as part of the extruded resin composition. By having the metal plate 17 employed to form the bottom surface 5*b* of the trochoid-accommodating recessed portion 5*a*, planarity is superior to when the bottom surface is formed of a plastic, and variability in ejection performance can be minimized. The side surface 5*e* constituting the trochoid-accommodating recessed portion 5*a* is extruded from the resin composition, whereby the frictional wear characteristics against the outer rotor 2 are improved, and generation of abraded metal dust can be reduced.

For the metal plate 17, a sintered metal body or cast metal body (pressed sheet metal) can be employed. The sintered metal body material can be one similar to that of the pump cover discussed earlier; as cast metal materials, iron, aluminum, aluminum alloy, copper, copper alloy, and the like may be cited. The use of a sintered metal body is preferred, for excellent dimensional stability, and secure integration with the resin sections due to good anchoring effect during injection molding.

In preferred practice, the pump casing has a groove situated in a section that is employed to seal the outside periphery of the recessed portion, a seal member (seal ring) being installed within the groove. The groove can be formed in the mold during injection molding. In the embodiment shown in FIGS. 1-3, a groove 5*e* is provided in an outer peripheral section of the recessed portion 5*a* of the pump casing 5, and a seal member 16 is installed within this groove 5*e*. By installing the seal member 16, leakage of liquid from the mating surfaces of the pump casing 5 and the pump cover 6, which are non-machined surfaces made of resin, can be prevented, variability in the ejection rate can be minimized, and higher safety can be achieved. The material for the seal member 16 can be the same as that of the seal member 10 provided to the intake cover 8.

In cases in which a plastic pump casing is secured by securing screws to a main body machine, the secured portions may loosen due to creep deformation of the plastic. While it is possible to address creep by employing a PPS resin composition incorporating a reinforcing agent like those mentioned above, in some cases the material may be brittle and have low impact resistance. For this reason, in preferred practice, bushings or flanged bushings made of sintered metal or cast metal are press-fitted into the screw securing hole sections, or are integrally formed by composite molding during the injection molding process. By employing sintered metal components, the plastic can penetrate into surface recesses of the sinters, joining the sintered metal component and the plastic through an anchoring effect. In particular, joining strength is markedly improved by arranging the bushings within the mold during injection molding, and integrating the parts through composite molding (insert molding).

In the embodiment shown in FIGS. 1 to 3, sintered metal bushings 7 are integrated into screw securing hole sections of the injection-molded pump casing 5 by composite molding during injection molding, and the pump casing 5 and the sintered metal pump cover 6 are securely secured to the securing plate 14 of the machine main unit by securing screws 12 passed through the bushings 7.

Figure 4:
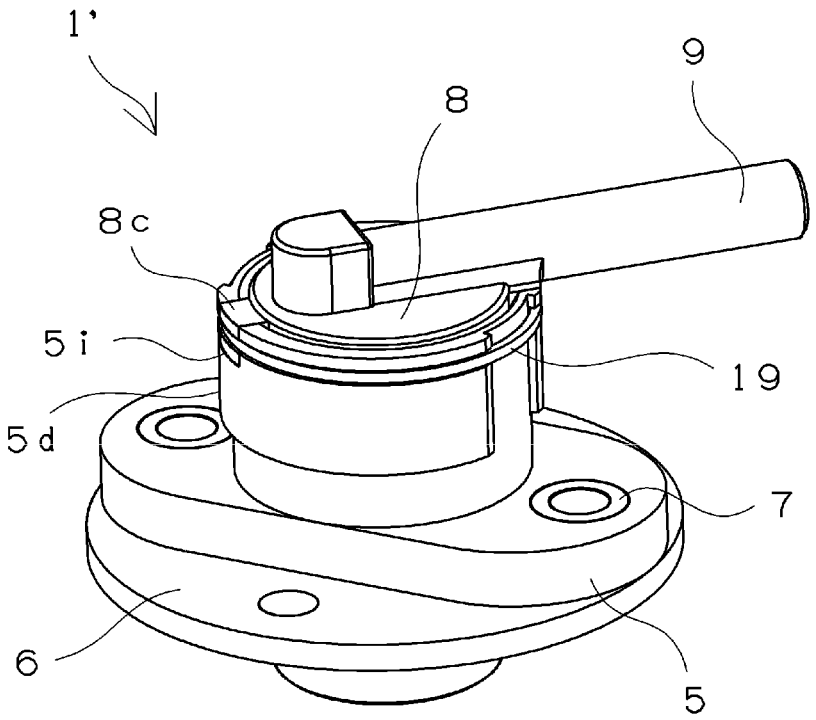
FIG. 4 is a perspective view showing another example of the transverse internal gear pump of the present invention.
Figure 5:
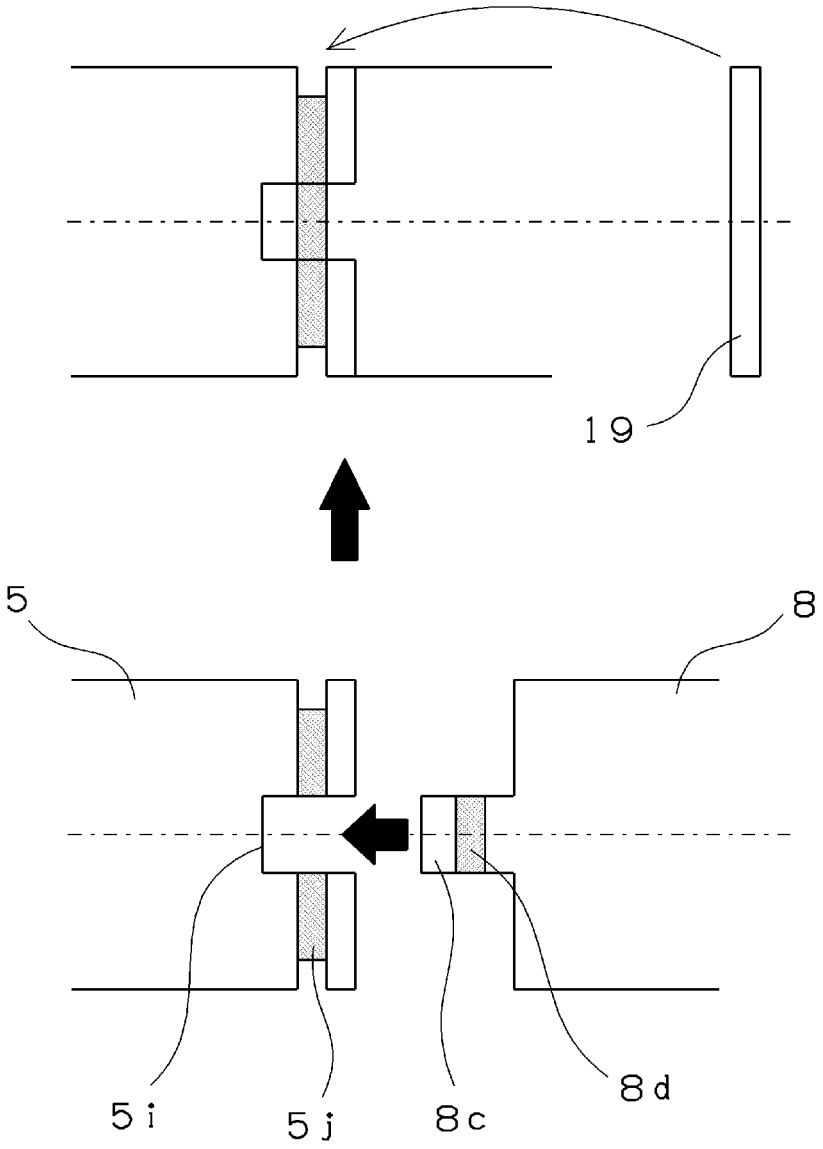
FIG. 5 is a model diagram of a securing method that utilizes a retaining ring.
Figure 6:
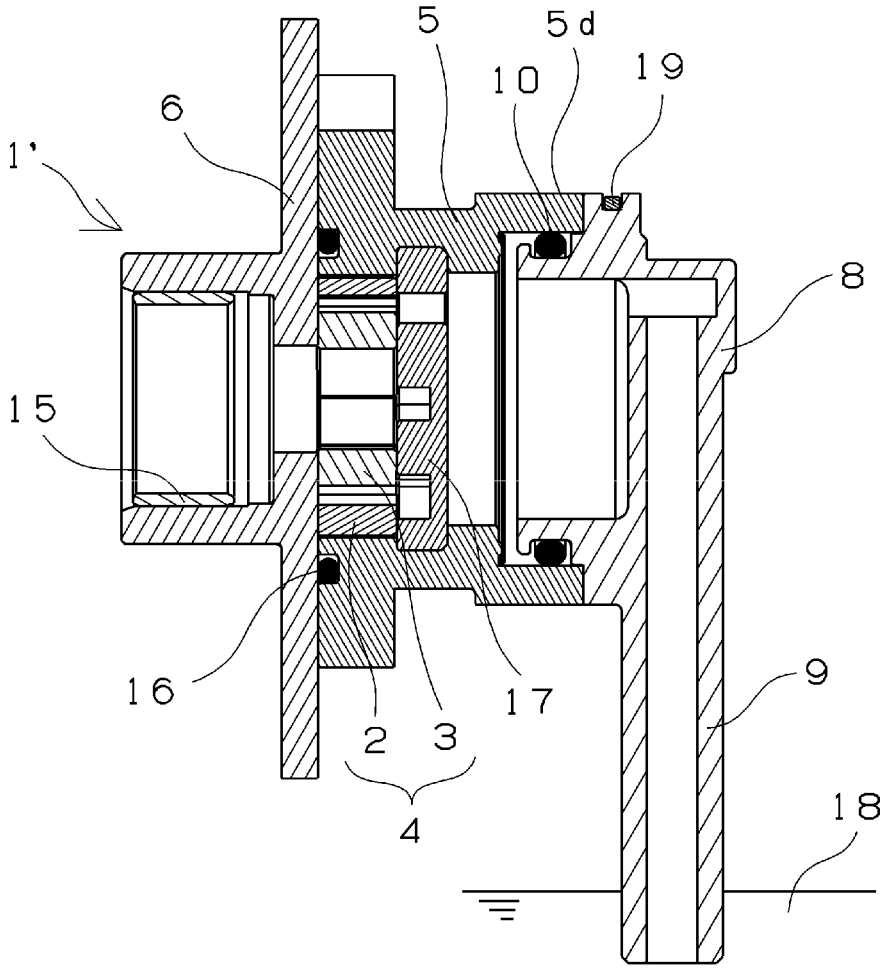
FIG. 6 is an axial cross-sectional view of the transverse internal gear pump of FIG. 4.

Another embodiment of the transverse internal gear pump of the present invention will be described on the basis of FIGS. 4 to 6. FIG. 4 shows a perspective view of a transverse internal gear pump that utilizes a retaining ring, FIG. 5 a model diagram of a securing method that utilizes a retaining ring, and FIG. 6 an axial cross-sectional view of the transverse internal gear pump of FIG. 4, respectively. As shown in FIGS. 4 and 6, the transverse internal gear pump 1' of this embodiment is a pump of which the principal constituents, such as a trochoid 4 composed of an outer rotor 2 and an inner rotor 3, a pump casing 5, a pump cover 6, an intake cover 8 having a liquid intake nozzle 9, a metal plate 17, a bearing 15, and the like, are similar to the case shown previously in FIGS. 1 to 3. The liquid intake nozzle 9 and the intake cover 8 are composed of an integrally molded article integrally molded from a resin composition by injection molding, a linking port linking the liquid intake nozzle 9 and the interior space of the intake cover 8 being disposed in a location above a vertical center portion of the interior space of the intake cover 8 at the time of pump installation. In this embodiment, the intake cover 8 is mated with a cylindrical part 5*d* of the pump casing 6 with a seal member 10 interposed therebetween, and secured by a prescribed structure that utilizes a metal retaining ring 19 having an end gap.

The securing structure utilizing a retaining ring will be described from FIG. 5. As shown in FIG. 5, the intake cover 8 has a protruding portion 8*c* and a groove 8*d* formed in the protruding portion. The pump casing 5 has a recessed portion 5*i* adapted to mate with the protruding portion 8*c*, and a groove 5*j* formed to extend through the recessed portion. When the protruding portion 8*c* of the intake cover and the recessed portion 5*i* of the pump casing 5 are mated, a continuous circumferential groove is formed by the groove 8*d* and the groove 5*j*. The retaining ring 19, with an end gap open to induce elastic deformation, is placed in this circumferential groove, and fitted therein with the retaining ring 19 spanning the intake cover 8 and the pump casing 5, securing the two members so as to not come away in the axial direction. Additionally, by mating of the protruding portion 8*c* and the recessed portion 5*i*, the intake cover 8 and the pump casing 5 are prevented from turning in the circumferential direction. There are no particular limitations as to the retaining ring provided that the ring can fit inside the groove and maintain stable securing force for extended periods; besides the metal (gapped) component mentioned above, it would be acceptable to adopt a plastic (gapped) component, a rubber (gapless) component, or the like.

Figure 7:
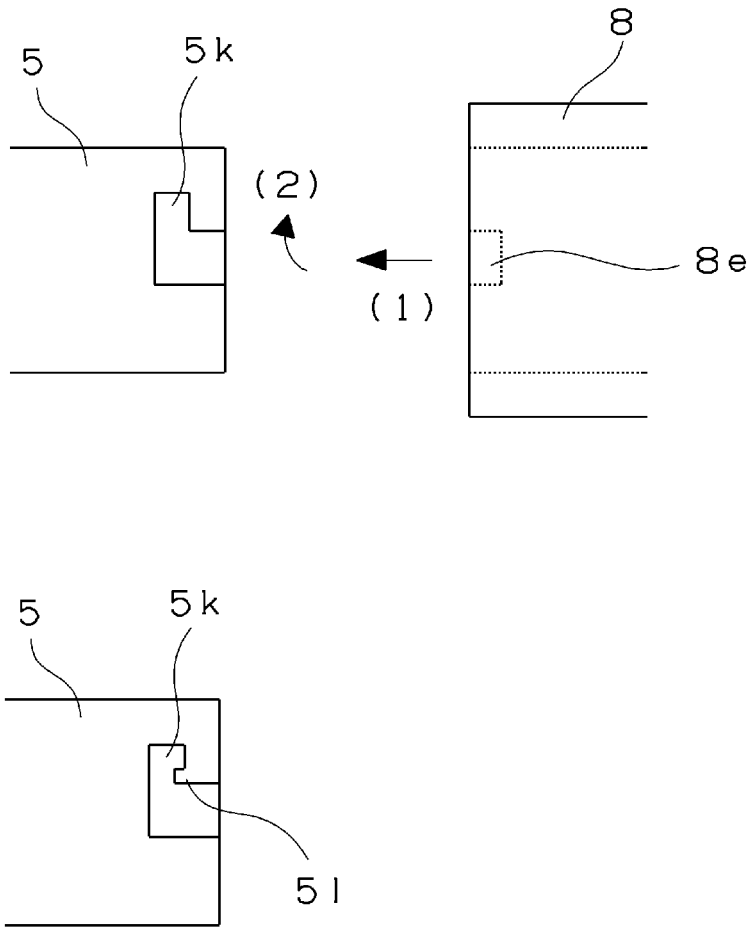
FIG. 7 is a model diagram of a securing method that utilizes rotation-induced meshing of a protrusion and a recession.

Another mode of securing the intake cover and the pump casing will be described on the basis of FIG. 7. FIG. 7 is a model diagram of a securing method that utilizes rotation-induced meshing of a protrusion and a recession. As shown in FIG. 7 (at top), the pump casing 5 has an "L" shaped recessed portion 5*k* on a cylindrical outer peripheral surface, and the intake cover 8 has a protruding portion 8*e* adapted to mate with the recessed portion 5*k* on the cylindrical inner peripheral surface. After (1) fitting the protruding portion 8*e* horizontally into the recessed portion 5*k*, (2) the parts are secured through relative rotation towards the upper side in the circumferential direction, causing the protruding portion 8*e* to fit into the back of the "L" shape of the recessed portion 5*k*. As shown in FIG. 7 (at bottom), a small projection 51 is formed at the front of the "L" shape of the recessed portion 5*k*, preventing separation subsequent to mating, and making secure securing possible.

In the embodiments shown in FIG. 4 and FIG. 7, the protruding portion is disposed on the intake cover side, and the recessed portion is disposed on the pump casing side, but a configuration representing the reverse; i.e., where the recessed portion is disposed on the intake cover side, and the protruding portion is disposed on the pump casing side, would be acceptable as well.

Figure 8:
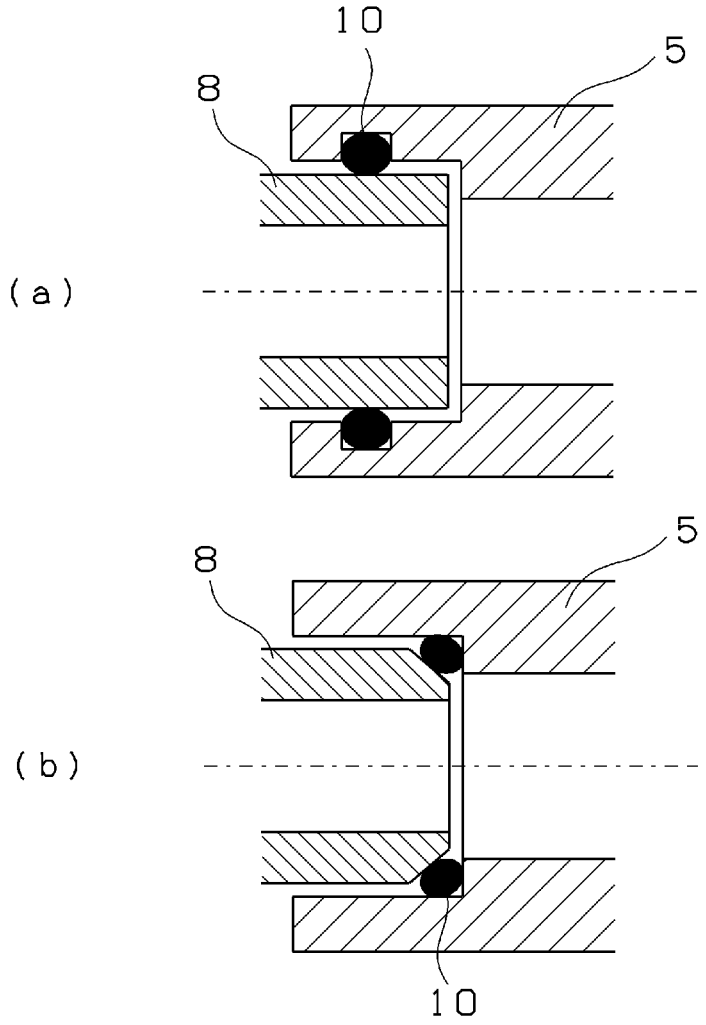
FIG. 8 is a simplified cross-sectional view showing another example of a seal structure.

While securing using a snap fit, securing using a retaining ring, and securing using rotation-induced meshing of a protrusion and a recession have been described hereinabove as modes of securing the intake cover and the pump casing, these methods are not provided by way of limitation; any securing method could be adopted, provided that the intake cover and the pump casing can be secured while maintaining sealing properties. Combinations of several of these securing methods may be applied as well. With regard to the seal structure, in each case the seal member is disposed in a groove in the intake cover, but such an arrangement is not provided by way of limitation; other acceptable embodiments are, for example, a mode of disposing a seal member in a groove in the pump casing 5 as shown in FIG. 8(*a*), or a mode of disposing a seal member at the mated corners of the intake cover 8 and the pump casing 5 as shown in FIG. 8(*b*).

According to the present invention, there may be adopted a mode in which, depending on the overall configuration of the pump, the intake cover is secured to the pump cover. Also, according to the present invention, while the liquid intake nozzle and the intake cover are integrally molded by the injection molding of a resin composition, the embodiments described above are not intended to limit the shapes or materials of the other components. For example, the pump casing could be made of metal. In this case, the intake cover could be secured by a pressure fit to the pump casing, and sealing properties maintained without interposing a seal member.

In cases in which a metal plate and/or bushings are disposed within a plastic pump casing using insert molding, as with the transverse internal gear pumps of the embodiments shown in FIG. 3 and FIG. 6, it is not an easy matter to integrally mold the liquid intake nozzle, which is non-perpendicular to the cylinder axial direction, at the same time. By fabricating the intake cover having the liquid intake nozzle as a separate part from the pump casing as in the present invention, and securing the parts while maintaining high sealing properties through securing methods such as the above, an excellent balance between producibility and product quality may be achieved.

INDUSTRIAL APPLICABILITY

The transverse internal gear pump of the present invention can be inexpensively manufactured, while exhibiting a high safety factor in terms of functionality, and can thus be utilized in pumps (trochoid pumps) for pumping liquids such as oil, water, chemical solutions, and the like. The gear pump can be used in a particularly suitable manner in pumps of which long-term reliability is required, such as those for supplying liquids to sliding parts of scroll compressors used in electric water heaters, room air conditioners, or car air conditioning.

EXPLANATION OF REFERENCE NUMERALS AND SYMBOLS

1, 1' Transverse internal gear pump
2 Outer rotor
3 Inner rotor
4 Trochoid
5 Pump casing
6 Pump cover
7 Sintered metal bushing
8 Intake cover
9 Liquid intake nozzle
10 Seal member
11 Metal filter
12 Securing screw
13 Drive shaft
14 Machine main unit securing plate
15 Bearing
16 Seal member
17 Metal plate
18 Liquid reservoir
19 Retaining ring

The invention claimed is:

1. A transverse internal gear pump, comprising: a trochoid, in which an inner rotor having a plurality of outer teeth is rotatably accommodated within an outer rotor having a plurality of inner teeth, the inner rotor being rotatably accommodated within the outer rotor in an eccentric state and with the outer teeth and the inner teeth meshing, and in which an intake-side volume chamber for taking in a liquid and an ejection-side volume chamber for ejecting liquid taken into the intake-side volume chamber are formed between the inner teeth and the outer teeth; and a liquid intake nozzle extending in a non-perpendicular direction with respect to rotation surfaces of the trochoid, the liquid intake nozzle having a distal end immersed in a liquid reservoir of the liquid, and forming part of a passage via which the liquid communicates with the intake-side volume chamber;

wherein the transverse internal gear pump is characterized by having a pump casing in which a recessed portion for accommodating the trochoid is formed, and a pump cover for closing off the recessed portion;

an intake cover having the liquid intake nozzle being secured to the pump casing, and the liquid intake nozzle and the intake cover being integrally molded by injection molding a resin composition;

a port linking an interior of the liquid intake nozzle and a space in an interior of the intake cover being disposed in a location that, when the pump is installed, is above a vertically central portion of the space in the interior of the intake cover; and the pump casing and the intake cover being fitted together with a seal member interposed therebetween, and being secured using elastically deforming engaging portions provided to the pump casing and the intake cover.

2. The transverse internal gear pump of claim 1, characterized in that the resin composition is a resin composition in which a polyphenylene sulfide resin is used as a base resin, and at least one material selected from glass fibers, carbon fibers, and inorganic fillers is incorporated therein.

3. The transverse internal gear pump of claim 1, characterized in that the transverse internal gear pump is a pump for supplying the liquid to a sliding section of a scroll compressor.

* * * * *